US008399817B1

(12) United States Patent
Rayms-Keller et al.

(10) Patent No.: US 8,399,817 B1
(45) Date of Patent: Mar. 19, 2013

(54) MICRO DESIGNATOR DART

(75) Inventors: Alfredo N. Rayms-Keller, Fredericksburg, VA (US); Francisco Santiago, Fredericksburg, VA (US); Victor H. Gehman, Jr., Dahlgren, VA (US); Karen J. Long, Upper Marlboro, MD (US); Kevin A. Boulais, Waldorf, MD (US); Peter L. Wick, Fredericksburg, VA (US); Alexander Strugatsky, King George, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/136,903

(22) Filed: Aug. 12, 2011

(51) Int. Cl.

| | |
|---|---|
| ***F42B 12/40*** | (2006.01) |
| ***F42B 15/01*** | (2006.01) |
| *F42B 12/00* | (2006.01) |
| *F42B 15/00* | (2006.01) |

(52) U.S. Cl. ..... 244/3.16; 244/3.1; 244/3.15; 244/3.17; 102/501; 102/513

(58) Field of Classification Search ..... 89/1.11; 244/3.1–3.19; 102/501, 502, 513; 701/1, 701/23; 33/227; 342/42, 43, 45, 50–54, 342/61–63, 350, 385

See application file for complete search history.

(56) References Cited

U.S. PATENT DOCUMENTS

| | | | | |
|---|---|---|---|---|
| 3,712,228 | A * | 1/1973 | Handler et al. | 102/513 |
| 3,940,605 | A * | 2/1976 | Gerber | 102/513 |
| 5,341,142 | A | 8/1994 | Reis | 342/64 |
| 5,396,243 | A * | 3/1995 | Jalink et al. | 342/54 |
| 5,458,041 | A | 10/1995 | Sun et al. | 89/1.11 |
| 5,461,982 | A * | 10/1995 | Boyer, III | 102/513 |
| 5,515,061 | A * | 5/1996 | Hiltz et al. | 342/385 |
| 5,654,524 | A * | 8/1997 | Saxby | 102/513 |
| 6,155,174 | A * | 12/2000 | Hervieu et al. | 102/513 |
| 6,215,390 | B1 | 4/2001 | Lin | |
| 6,276,088 | B1 | 8/2001 | Matthews et al. | |
| 6,293,204 | B1 | 9/2001 | Regen | |
| 6,359,681 | B1 | 3/2002 | Housand et al. | |
| 6,378,439 | B1 * | 4/2002 | Saxby | 102/513 |
| 6,610,971 | B1 | 8/2003 | Crabtree | 244/3.1 |
| 6,650,283 | B2 | 11/2003 | Brydges et al. | |
| 6,768,465 | B2 * | 7/2004 | Stewart, II | 342/43 |
| 6,842,138 | B1 * | 1/2005 | Wilkinson | 342/62 |
| 6,931,993 | B1 * | 8/2005 | Manole et al. | 102/513 |
| 6,941,850 | B1 | 9/2005 | McMahon | |
| 6,990,905 | B1 * | 1/2006 | Manole et al. | 102/513 |
| 7,055,438 | B1 * | 6/2006 | Manole et al. | 102/513 |
| 7,278,358 | B2 * | 10/2007 | Huffman | 102/502 |
| 7,331,293 | B2 * | 2/2008 | Saxby | 102/513 |
| 7,343,231 | B2 * | 3/2008 | Zoltan | 701/23 |
| 7,475,638 | B2 * | 1/2009 | Haeselich | 102/513 |
| 7,979,992 | B2 * | 7/2011 | Filep | 33/227 |
| 8,065,962 | B2 * | 11/2011 | Haeselich | 102/513 |
| 2006/0219094 | A1 | 10/2006 | Padan | |

* cited by examiner

*Primary Examiner* — Bernarr Gregory
(74) *Attorney, Agent, or Firm* — Gerhard W. Thielman, Esq

(57) ABSTRACT

A micro designator dart engages a target to allow for designation and tracking of the target by transmitting a radio-frequency identification code. The housing of the micro designator dart is configured to enclose its components and deform upon impact with a target to allow a target-engaging member to physically attach the micro designator dart to the target. Also upon impact with the target, an impact-sensitive triggering mechanism in the micro designator dart activates a power source, causing a transmitter to send a predetermined coded infrared signal to the seeker unit of a precision guided munitions system. The micro designator dart may also include a self-destruct device.

20 Claims, 5 Drawing Sheets

MICRO DESIGNATOR DART

STATEMENT OF GOVERNMENT INTEREST

The invention described herein was made in the performance of official duties by one or more employees of the Department of the Navy, and the invention herein may be manufactured, practiced, used, and/or licensed by or for the Government of the United States of America without the payment of any royalties thereon or therefore.

FIELD OF INVENTION

The present invention relates to the field of tracking devices and systems, and specifically to a micro designator dart for use with precision guidance munitions systems.

TERMINOLOGY

Figure 1:
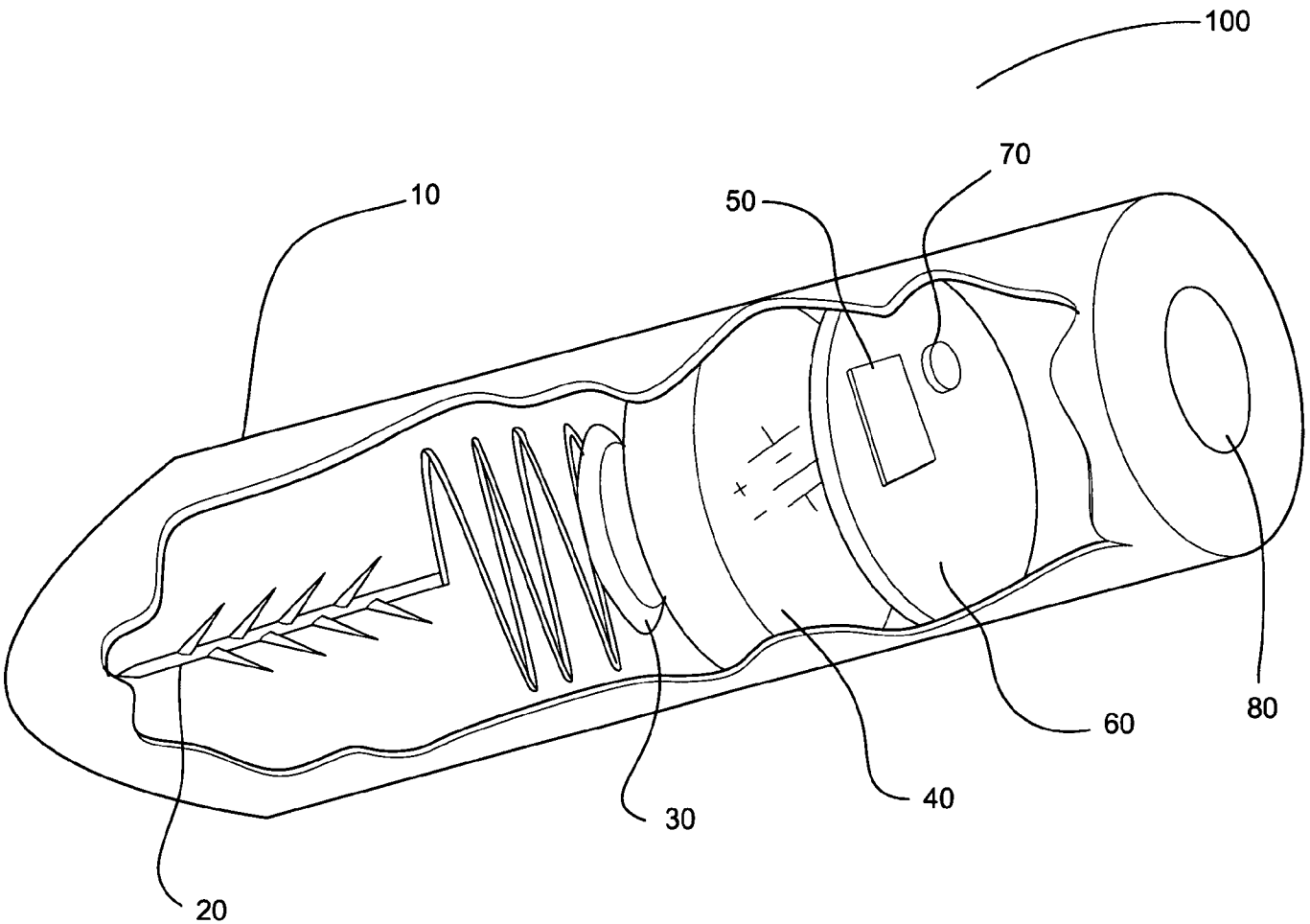
FIG. 1 illustrates an exemplary embodiment of a micro designator dart.

As used herein, the term "biological adhesion component" means a component that adheres to an object using techniques derived from a live organism or organic matter, such as the adhesion ability of a gecko.

As used herein, the term "chemical adhesion component" means an adhesive or other substance that adheres to another object due to its chemical composition.

As used herein, the term "controller" means a device that controls the power provided to a radio transmitter and other devices and provides directions to such devices.

As used herein, the term "deformable" means a structure that changes its shape, size, dimensions or other physical properties upon impact with a surface.

As used herein, the term "electromagnetic adhesion component" means a magnet or any other device that adheres to an object through the use of the properties of an electrical or magnetic field.

As used herein, the term "impact-sensitive triggering mechanism" means a structural component that will activate a power source after it strikes another object.

As used herein, the term "multi-directional" refers to a device capable of transmitting a signal in more than one direction.

As used herein, the term "pierceable membrane" refers to a portion of a deformable housing adapted to expose a target-engaging member.

As used herein, the term "piercing structure" refers to a component that causes penetration, piercing, or adherence by structural properties such as piercing points, spikes, contours, grooves or interlocking components.

As used herein, the term "predetermined projectile path" means the trajectory of a projectile determined in a manner that the projectile will strike a selected target.

As used herein, the term "projectile-launching device" refers to a device capable of launching a projectile such as a micro designator dart with sufficient force that the dart will adhere to the desired target object. Such a device may include, but not be limited to, a rifle, a hand gun, a munitions system, a gas gun, an air gun, a crossbow, a bow, a slingshot, or a human.

As used herein, the term "quasi-unique signal" refers to a predetermined coded infrared signal that may or may not be encrypted on one or more levels and which is identifiable as being transmitted from a specific source.

As used herein, the term "radio-frequency identification module" refers to any device programmed to produce a predetermined coded infrared signal that can be interpreted seeker unit.

As used herein, the term "seeker unit" refers to the component of a precision guided munitions system that locates and tracks the intended target and guides the munitions to the target.

As used herein, the term "self-destruct device" refers to a component designed to destroy itself and the device containing it and which may be comprised of an encapsulated explosive, an acid, a corrosive, or combinations thereof.

As used herein, the term "structural deformation site" refers to any contour, aperture, perforation, area of different or altered material, weakness or any other structural modification known in the art that allows a housing to specifically change its shape, size, dimensions or other physical properties when force is imparted on that housing.

As used herein, the term "target-engaging member" refers to any structure, device, method or material which may permanently or selectively attach a micro designator dart to a surface. A target-engaging member may include, but is not limited to, a piercing structure and may also include magnets, adhesives, methods of biological adhesion, or other method or structure, or combination of methods and structures.

BACKGROUND OF THE INVENTION

Precision-guided munitions (PGMs) and munitions systems are used to strategically hit a specific target in order to minimize damage to surrounding areas and civilians. Reducing casualties is a goal which dominates tactical decisions when planning military actions.

Improved guided munitions technologies have significantly reduced casualties. For example, the number of civilian deaths for the current Iraq conflict is estimated to be 19 times less than that for the WWII bombings in Germany, and approximately 162 times less than that for the WWII bombings of Japan.

However, ground and aircraft personnel involved in munitions operations which involve "tagging" a target are still at great risk despite the considerable accuracy of the weapons.

Laser-guided PGM systems known in the art require a target to be tagged or tracked by a designator manually operated by a person on the ground or in an aircraft. To tag a target, a human operator, whether on-ground or in an aircraft, aims a laser designator at the target. The laser designator's beam usually occurs in a series of coded pulses, which allows multiple designators to operate in close proximity. The human operator must keep the laser designator on the target until the signal is no longer needed.

Use of a human operator imposes other logistical burdens and costs. Considerable technical planning is necessary to avoid ground and aircraft personnel casualties. In addition, laser target designators cannot be used when it is not practical or safe to place a human operator near enough to the target for tagging.

There is an unmet need for technology which can tag a target without placing ground and air personnel at risk and which is compatible with current guided munitions systems and seeker subsystems.

SUMMARY OF THE INVENTION

The present invention is a micro designator dart with a deformable housing which forms at least one internal chamber containing a radio-frequency identification module, a signal transmitter, a controller, a power source, impact-sensitive triggering mechanisms, and a target-engaging member. The target-engaging member attaches the housing to the target, and the act of attachment activates a triggering mechanism. The impact-sensitive triggering mechanism activates the power source, which is operatively coupled to the controller. The controller is configured with software to activate the signal transmitter and initiate transmission of a predetermined coded infrared signal which is received by a remotely located receiver.

Various embodiments of the invention may utilize nanotechnology and micro technology, such as MEMS (Micro-Electronic-Mechanical-Systems), to design a system that could launch and deliver a designator system using a standard rifle or other projectile launcher, therefore leaving the shooter out of danger.

DETAILED DESCRIPTION

For the purpose of promoting an understanding of the present invention, references are made in the text to exemplary embodiments of a micro designator dart, only some of which are described herein. It should be understood that no limitations on the scope of the invention are intended by describing these exemplary embodiments. One of ordinary skill in the art will readily appreciate that alternate but functionally equivalent materials, components, and configurations may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1 illustrates an exemplary embodiment of micro designator dart 100. As illustrated, micro designator dart 100 is adapted for use with a rifle or other projectile-launching device or munitions system. In various exemplary embodiments, housing 10 may be of any shape that is contoured to serve as an aerodynamic ballistic projectile, including, but not limited to, bullet shaped, conical, spherical, oblong, tapered, pointed, rounded, globular, and elongated. Housing 10 must be deformable or compressible on impact but may be made of any metal, plastic rubber, fabric, or other material capable of forming a semi-rigid and deformable housing.

In the exemplary embodiment shown in FIG. 1, radio-frequency identification (RFID) module 50 is any processing component or memory storage device configured to produce or store a predetermined coded infrared signal that can be interpreted by a precision-guided munitions seeker unit (not shown) to identify a target. In various embodiments, the predetermined coded infrared signal may be a quasi-unique or encrypted signal. Before launching micro designator dart 100, RFID module 50 transmits the predetermined coded infrared signal to be used by a seeker unit.

Also shown in FIG. 1 is controller 60, which controls power source 40 and operatively couples power source 40 and transmitter 80. Controller 60 also controls the operation and performance of RFID module 50.

In the exemplary embodiment shown in FIG. 1, power source 40 is a battery that provides power to controller 60 and, therefore, transmitter 80. In further embodiments, power source 40 may be a capacitor, a solar energy converter, MEMS component, NEMS component, accumulator or any other device known in the art that may be used to supply power to controller 60.

FIG. 1 also includes transmitter 80. When activated and powered by controller 60, transmitter 80 sends the predetermined coded infrared signal produced by RFID module 50 to a seeker unit or other receiver unit.

FIG. 1 also includes impact-sensitive triggering mechanism 30, which turns on or activates power source 40. In the exemplary embodiment shown in FIG. 1, impact-sensitive triggering mechanism 30 is a spring and rupture disk, but in further embodiments, it may be various structures adapted to pierce a rupture disk, including, but not limited to, a pin, dart, blade, serrated edge, and combinations of these structures. When housing 10 is deformed during impact with a target, the spring expands to puncture the rupture disk, which activates power source 40.

In the exemplary embodiment shown, in order to prevent premature activation, triggering mechanism 30 is designed not to activate unless micro designator dart 100 experiences a reverse force of more than 70 foot pounds. In further exemplary embodiments, triggering mechanism 30 may be configured with more or less sensitivity. In still further exemplary embodiments, triggering mechanism 30 may be secured for shipping and storage.

In further exemplary embodiments, triggering mechanism 30 may be designed to not activate from a free fall of less than a specified distance, such as 2 meters. For example, triggering mechanism 30 may be designed to not activate until an impact force greater than that generated by a 2 meter drop. In still further exemplary embodiments, triggering mechanism 30 may be configured with an accelerometer or other device capable of measuring accelerations, changes in direction or other forces exhorted upon micro designator dart 100 which may cause triggering mechanism 30 to activate or not.

FIG. 1 also illustrates target-engaging member 20. In the exemplary embodiment shown in FIG. 1, target-engaging member 20 is a barbed spike. However, in further exemplary embodiments, target-engaging member 20 may be any structure or material that may be used to physically secure micro designator dart 100 to a target. For example, target-engaging member 20 may be a barbed or non-barbed spike, hook, magnet, hook-and-loop fastener, a chemical, biological, or electromagnetic adhesion component, or other method or structure, or combination of methods and structures that allow target-engaging member 20 to secure micro designator dart 100 to a target.

Also shown in FIG. 1 is optional self-destruct device 70, which is a device to destroy micro designator dart 100 when necessary. Self-destruct device 70 is activated by controller 60. In various embodiments, self-destruct device 70 may be time-delayed. For example, controller 60 may be programmed to detonate self-destruct device 70 at a predetermined time following activation of transmitter 80. Self-destruct device 70 may also be configured to activate at another predetermined time. In still further exemplary embodiments, self-destruct device 70 may be remotely activated. When designed to be remotely activated, self-destruct device 70 or controller 60 may require additional signal-receiving and activation components.

In the embodiment shown in FIG. 1, self-destruct device 70 is an encapsulated explosive. In still further exemplary embodiments, self-destruct device 70 may contain a substance or device other than an encapsulated explosive, such as an acid, corrosive, or any other destructive substance known in the art to destroy micro designator dart 100.

In some exemplary embodiments, self-destruct device 70 may be designed to destroy the entire micro designator dart 100. Destruction of the entire micro designator dart 100 may avoid the necessary implementation of counter measure to retrieve any sensitive data or technology. However, in other exemplary embodiments, self-destruct device 70 may be designed to destroy only specific components of micro designator dart 100. For example, self-destruct device 70 may be configured to destroy only controller 60. In still further exemplary embodiments, self-destruct device 70 may be configured to destroy a select group of components, such as RFID module 50, controller 60 and transmitter 80.

In further exemplary embodiments, self-destruct device 70 may be specifically located or arranged within micro designator dart 100 to destroy specific components or groups of components.

In further exemplary embodiments, self-destruct device 70 may be designed or programmed to self-destruct upon impact of micro designator dart 100 with a target. In still further exemplary embodiments, self-destruct device 70 may be configured to self-destruct 70 at a specified time following impact.

In still further exemplary embodiments, self-destruct device 70 may be entirely omitted. For example, micro designator darts 100 used for training purposes may omit self-destruct device 70 or other components, such as controller 60, RFID module 50, triggering mechanism 30 or power source 40 in order to decrease some expenses associated with training. However, in order to preserve the weight, size and accuracy of training, additional weight components may be added to micro designator dart 100 for training purposes.

In the exemplary embodiment shown in FIG. 1, target-engaging member 20, impact-sensitive triggering mechanism 30, power source 40, RFID module 50, controller 60, self-destruct device 70, and transmitter 80 are all enclosed within housing 10.

In some exemplary embodiments, the position and arrangement of target-engaging member 20, impact-sensitive triggering mechanism 30, power source 40, RFID module 50, controller 60, self-destruct device 70, and transmitter 80 may differ in order to accommodate different housing shapes. For example, when housing 10 is spherical, components of micro designator dart 100 may be arranged non-linearly to accommodate the spherical housing.

In further exemplary embodiments, target-engaging member 20 may be contained within housing 10 or exposed on the exterior surface of housing 10.

In some exemplary embodiments, when significant force is not required to attach micro designator dart 100 to a target, micro designator dart 100 may be deployed by gas or air guns, crossbow, slingshot, or other low-impact means, including manually (e.g., throwing). For example, the force generated by a crossbow or other similar means of deployment is sufficient to attach micro designator dart 100 to soft targets, including, but not limited to, vehicles, cars, boats, rafts, unarmored surfaces, stucco, wood, plastics, composites and fabrics. However, the distance micro designator dart 100 needs to travel to engage a target is also a factor in determining the means of deployment.

In further exemplary embodiments, micro designator dart 100 may need to be physically altered in order to pierce harder targets, such as concrete, masonry and steel. For example, micro designator dart 100 may contain an appropriate metal (e.g., titanium), ceramic, polymer or other coatings and/or structures to enable the 'micro dart' to penetrate hard targets or resistant materials. Greater force is also required to pierce hard targets, and therefore greater speeds, and micro designator dart 100 may also be adapted to withstand these greater speeds. For example, velocities greater than 500 feet per second, or more than 200 foot pounds of force, are required at impact to penetrate concrete.

In still further exemplary embodiments, the force required to engage a target may be dependent on the composition and materials of micro designator dart 100, rather than the material of a target. For example, a micro designator dart 100 made of titanium or hard metal will require more force to deform, as opposed to a micro designator dart 100 made of plastic.

In some exemplary embodiments, micro designator dart 100 may be remotely deactivated, and transmitter 80 remotely turned off. Remotely deactivating micro designator dart 100 helps prevent against accidental signally. Additionally, a weapon programmed to seek micro designator dart 100 may be controlled by a forward observer who may deactivate the weapon if micro designator dart 100 attaches to the wrong target, accidentally begins transmitting or otherwise undesirably activates.

A weapon programmed to seek micro designator dart 100 may also be programmed to ignore a signal transmitted by micro designator dart 100. For example, if micro designator dart 100, or transmitter 80, is stolen, tampered with, or accidentally deployed or activated, any weapon programmed to seek micro designator dart 100 may be reprogrammed to ignore the specific signal transmitted by micro designator dart 100.

In the exemplary embodiment illustrated in FIG. 1, micro designator dart 100 is approximately the size and shape of a standard bullet with a metallic housing 10. In further exemplary embodiments, housing 10 may be contoured or be specifically designed for launching from a specific projectile-launching device, such as a rifle, crossbow, bow, slingshot, or other device. In various embodiments, micro designator dart 100 may be used with off-the-shelf weapons.

In further exemplary embodiments, micro designator dart 100 may use nanotechnology and micro technology, such as micro-electronic-mechanical-systems (MEMS) or nano-electronic-mechanical-systems (NEMS), in order to reduce the size and weight of micro designator dart 100.

Figure 2:
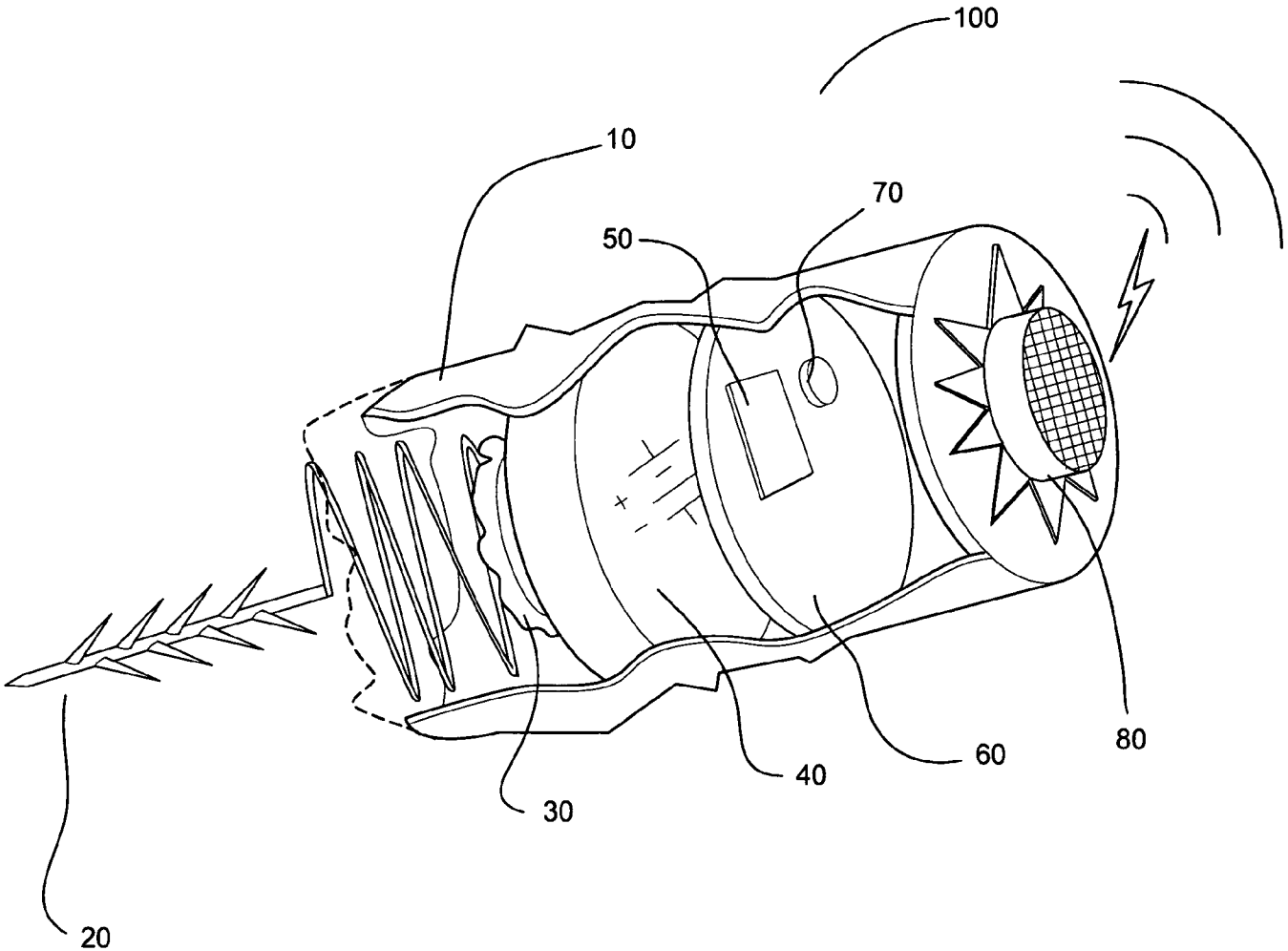
FIG. 2 illustrates an exemplary embodiment of a micro designator dart after impact.

FIG. 2 is an exemplary embodiment of micro designator dart 100 after impact with a target, with housing 10 deformed to expose target-engaging member 20 and transmitter 80. As illustrated, target-engaging member 20 has pierced housing 10. When target-engaging member 20 is a piercing structure, target-engaging member 20 must be exposed in order to engage the target.

In some exemplary embodiments, housing 10 may be configured with a pierceable membrane or area specifically adapted to be pierced by target-engaging member 20. In further exemplary embodiments, housing 10 may contain specific contours, perforations or other structural modifications that allow housing 10 to deform in a specific manner and expose target-engaging member 20.

In some exemplary embodiments, target-engaging member 20 may not be enclosed within housing 10. For example, target-engaging member 20 may be an adhesive, hook-and-loop fastener, magnet, or other device or structure that may be used on the exterior surface of housing 10 to engage a target. In still further exemplary embodiments, target-engaging member 20 may be securely fixed within housing 10 to engage a target. For example, a magnet may securely fixed within housing 10 and still engage a magnetic target.

In the exemplary embodiment shown in FIG. 2, impact-sensitive triggering mechanism 30 has been triggered, and the rupture disk is pierced. This activates power source 40.

As illustrated in FIG. 2, transmitter 80 is also shown exposed from housing 10. The deformation of housing 10 causes transmitter 80 to protrude from the rear of housing 10 and allows transmitter 80 to send emit a predetermined coded infrared signal in all directions. In some exemplary embodiments, however, transmitter 80 need not be exposed from housing 10, and, in further exemplary embodiments, transmitter 80 may be configured to emit a signal in only one direction or selected directions.

Figure 3:
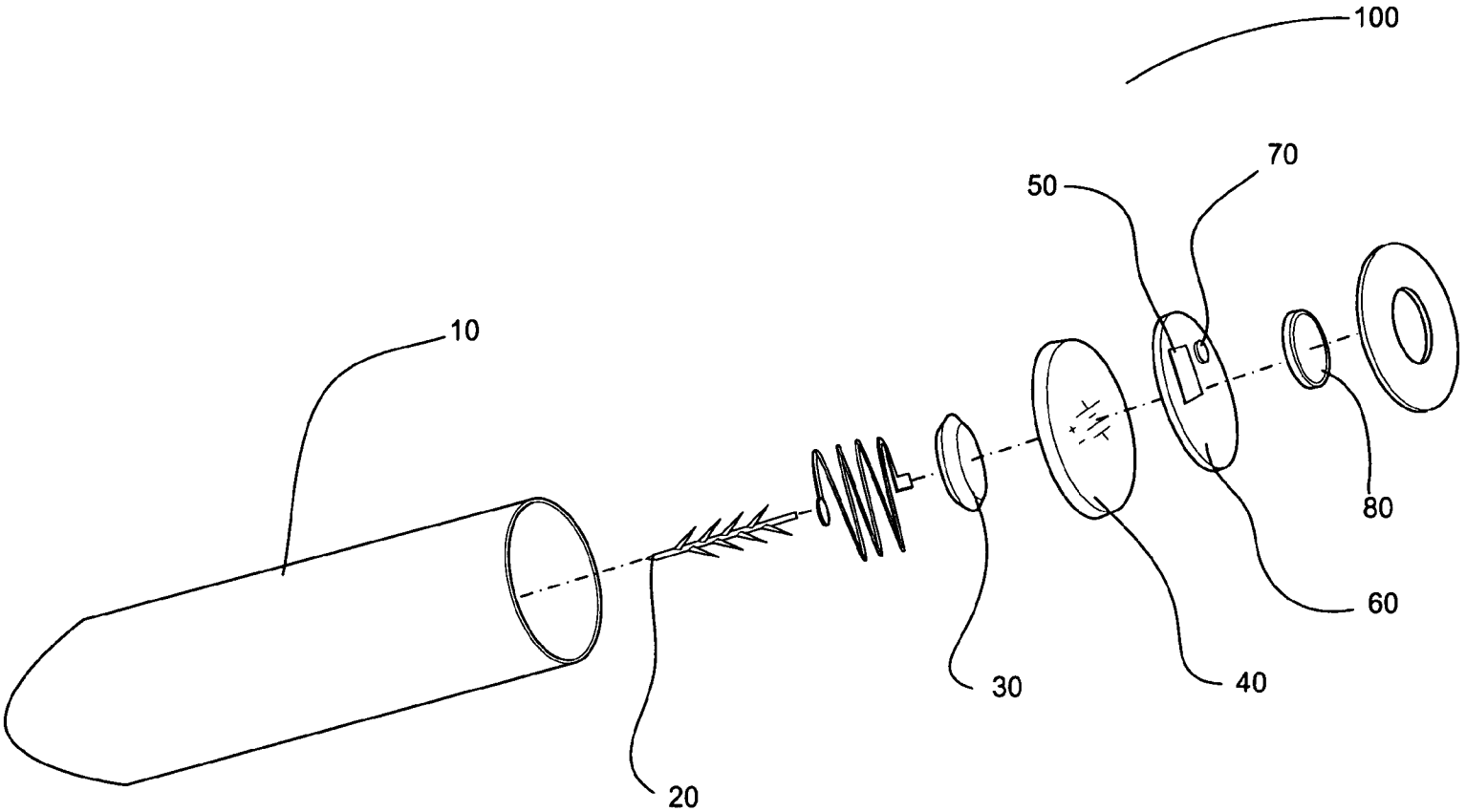
FIG. 3 is an exploded view of an exemplary micro designator dart.

FIG. 3 is an exploded view of an exemplary embodiment of micro designator dart 100. In the exemplary embodiment shown, housing 10 is a capsule with an internal chamber adapted to hold target-engaging member 20, impact-sensitive triggering mechanism 30, power source 40, RFID module 50, controller 60, self-destruct device 70, and transmitter 80.

In further exemplary embodiments, the shape, dimensions and materials of housing 10 may be adapted for use with a specific deployment method. In still further exemplary embodiments, internal components of micro designator dart 100 may be differently arranged or reconfigured to fit the shape of housing 10. Housing 10 may also contain more than one internal chamber in order to individually partition elements of micro designator dart 100.

Figure 4:
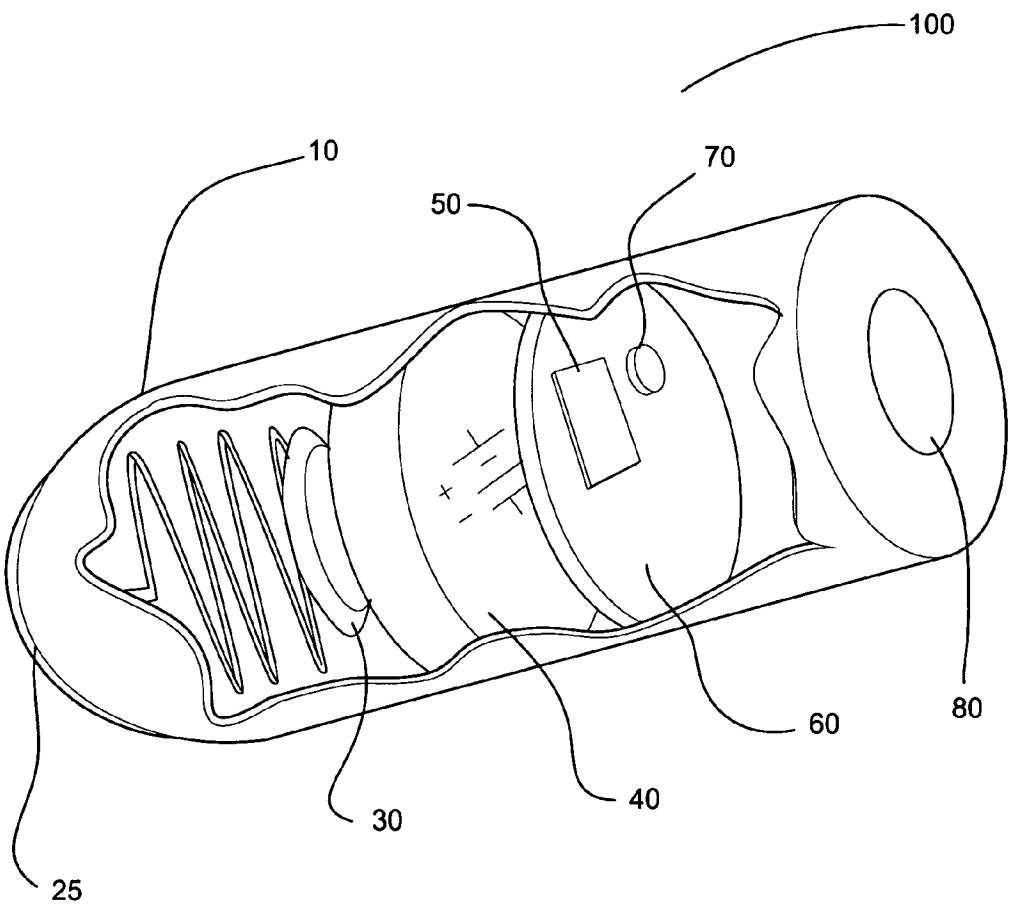
FIG. 4 is an alternative exemplary embodiment of a micro designator dart.

FIG. 4 is an alternative exemplary embodiment of micro designator dart 100. In the exemplary embodiment shown, target-engaging member 20 is an adhesive on the outside of housing 10. Because target-engaging member 20 is not enclosed within housing 10, housing 10 is shorter than the housing 10 illustrated in the exemplary embodiments shown in FIGS. 1-3. Further, housing 10 does not need to be configured with a pierceable membrane or other structure to expose target-engaging member 20 on impact or adapted to deform near target-engaging member 20.

Figure 5:
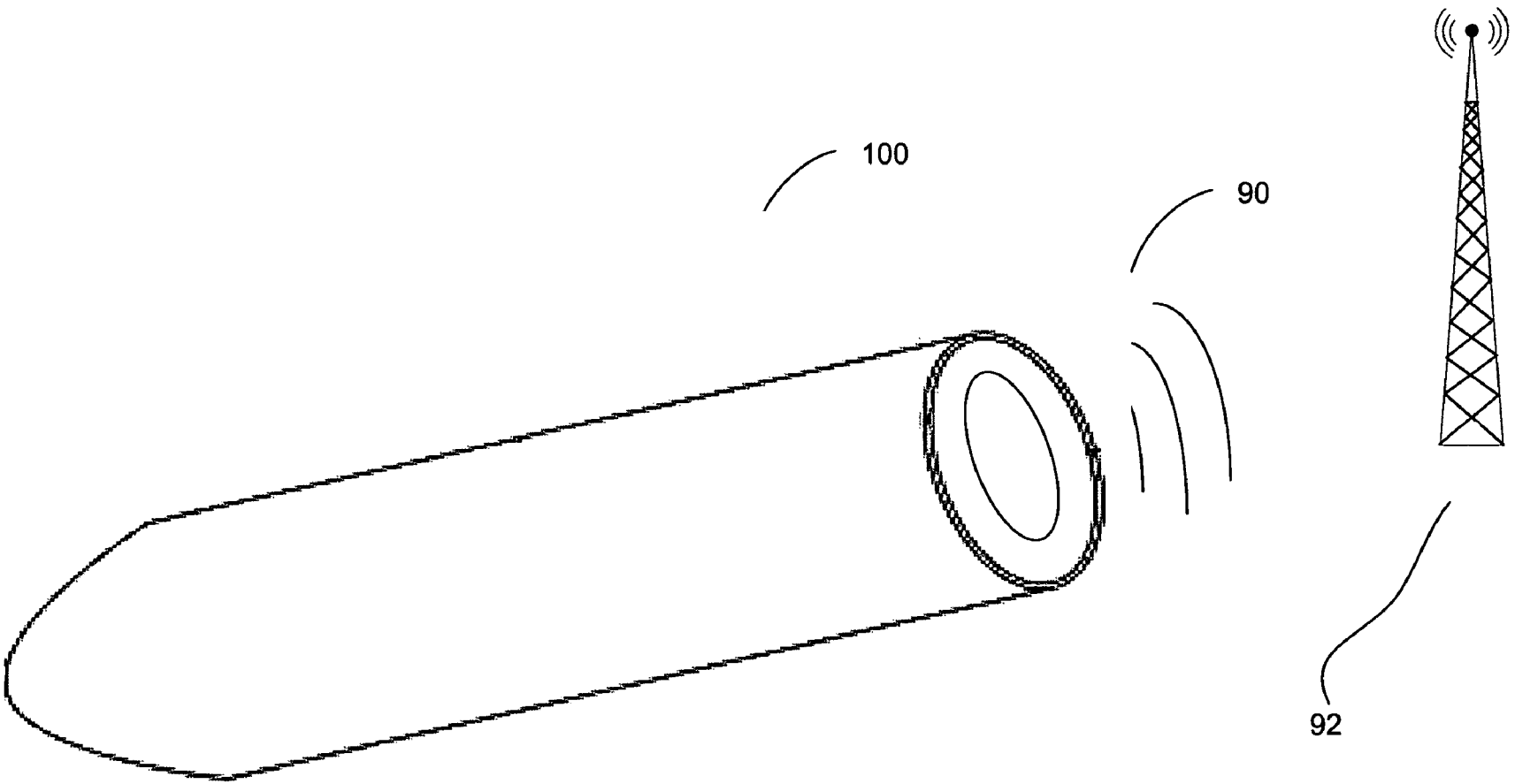
FIG. 5 illustrates an exemplary embodiment of a micro designator dart transmitting a predetermined coded infrared signal which is received by a receiver unit.

FIG. 5 illustrates an exemplary embodiment of micro designator dart 100 transmitting predetermined coded infrared signal 90 which is received by receiver unit 92. In the exemplary embodiment shown, receiver unit 92 is illustrated as a receiving antenna. In further exemplary embodiments, receiver unit 92 may be a seeker unit, guided projectile or munitions, tracking system or any other device known in the art to receive an infrared signal.

In the exemplary embodiments described in FIGS. 1-5, micro designator dart 100 may be directed towards a target in a number of ways, depending on the type of target and distance to the target. For example, micro designator dart 100 may be launched using any projectile launcher known in the art, including, but not limited to, guns, rifles, slingshots, crossbows, standard bows, and other devices. In other exemplary embodiments, micro designator dart 100 may be physically tossed or placed on a target.

Configuring micro designator dart 100 for use with multiple methods of deployment allows micro designator dart 100 to be used over a wide distance, from physical placement up to 1 mile or more, depending on the projectile launching device.

In some exemplary embodiments, micro designator dart 100 may be specifically designed to be used with a specific projectile launcher or to be launched on a specifically calculated trajectory. For example, micro designator dart 100 may be designed to follow a straight or parabolic trajectory.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A projectile for ejection from a munitions launcher for engaging a target, comprising:

an external housing having at least one deformable outer surface and at least one housing chamber;

a target-engaging member that connects said housing for attaching to the tartlet;

a power source disposed within said housing chamber;

a signal transmitter disposed within said housing chamber for initiating transmission of an infrared signal having a predetermined code;

a radio-frequency identification module disposed within said housing chamber and configured with software to automatically produce said infrared signal in response to activation by said power source;

a controller disposed within said housing chamber and operatively coupled with said radio-frequency identification module and configured with software to activate said signal transmitter to transmit said infrared signal, wherein said controller is operatively coupled with said power source; and an impact-sensitive triggering mechanism disposed within said housing chamber that activates said power source to provide electrical power to said controller upon contact with the target;

wherein said signal transmitter is operatively coupled with said controller; and wherein said infrared signal is capable of being read by a remote seeker unit.

2. The projectile of claim 1, wherein said external housing further includes at least one pierceable membrane.

3. The projectile of claim 2, wherein said target-engaging member is enclosed within said external housing and aligned with said pierceable membrane so as to penetrate said pierceable membrane.

4. The projectile of claim 1, wherein said target-engaging member is a piercing structure.

5. The projectile of claim 1, wherein said housing contains at least one structural deformation site.

6. The projectile of claim 1, wherein said target-engaging member is a chemical adhesion component.

7. The projectile of claim 1, wherein said target-engaging member is an electromagnetic adhesion component.

8. The projectile of claim 1, wherein said target-engaging member is a biological adhesion component.

9. The projectile of claim 1, wherein said impact-sensitive triggering mechanism further includes a rupture disk, and wherein said rupture disk is operatively coupled to said power source.

10. The projectile of claim 9, wherein said rupture disk is operatively coupled to a structure adapted to pierce said rupture disk, and further comprising at least one of a spring, a pin, a dart, a blade, and a serrated edge.

11. The projectile of claim 1, wherein said impact-sensitive triggering mechanism is activated upon the application of a compressive force of more than 70 foot pounds.

12. The projectile of claim 1, wherein said housing chamber includes a first internal chamber for containing said radio frequency identification module, said controller, said power source and said impact-sensitive triggering mechanism, and a second internal chamber for containing said signal transmitter.

13. The projectile of claim 1, wherein said infrared signal is a quasi-unique signal.

14. The projectile of claim 1, wherein said housing and said target-engaging member are configured for deployment by a specific projectile-launching device.

15. The projectile of claim 1, wherein said signal transmitter is a multi-directional transmitter.

16. The projectile of claim 1 further including a self-destruct component.

17. The projectile of claim 16, wherein said self-destruct component is further configured with software to initiate self-destruction following a pre-determined time delay.

18. A system for designating and tracking a target, comprising:

a remotely located receiver unit on a seeker unit configured with software to receive a coded infrared signal that guides munitions to the target;

projectile, comprising:

an external housing having at least one deformable outer surface and at least one housing chamber;

a target-engaging member that connects to said housing for attaching to the target;

a power source disposed within said housing chamber;

a signal transmitter disposed within said housing chamber for initiating transmission of an infrared signal having a predetermined code;

a radio-frequency identification module disposed within said housing chamber and that is configured with software to automatically produce said infrared signal in response to activation by said power source;

a controller disposed within said housing chamber and operatively coupled with said radio-frequency identification module and configured with software to activate said signal transmitter and initiate transmission of said infrared signal, wherein said controller is operatively coupled with said power source;

a self-destruct device disposed within said housing chamber; and an impact-sensitive triggering mechanism disposed within said housing chamber and that activates said power source to provide power to said module controller;

wherein said signal transmitter is operatively coupled with said controller and wherein said infrared signal is capable of being read by said remotely located seeker unit.

19. A method of tracking a target, comprising:

propelling from a launcher a projectile on a pre-determined projectile path toward the target, said projectile including a deformable housing and a target-engaging member attached thereto;

striking the target with a force necessary to cause said target-engaging member to adhere said projectile to the target and also induce sufficient compression of said housing thereby initiating an impact-sensitive triggering mechanism to activate a power source to supply power to a radio-frequency identification module, a controller, and a signal transmitter, each of said mechanism, power supply, identification module, controller and transmitter being contained within said housing;

transmitting an infrared signal having a predetermined code from said transmitter to a remotely located receiving device in a seeker unit;

tracking the location of the target by said seeker unit; and delivering precision guided munitions to the target via tracking.

20. The method of claim 19 further including activating a self-destruct device.

* * * * *